US010106951B2

(12) United States Patent
Myers

(10) Patent No.: US 10,106,951 B2
(45) Date of Patent: Oct. 23, 2018

(54) SYSTEM AND METHOD FOR AUTOMATIC DUMP CONTROL

(71) Applicant: Deere & Company, Moline, IL (US)

(72) Inventor: David J. Myers, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 101 days.

(21) Appl. No.: 15/271,571

(22) Filed: Sep. 21, 2016

(65) Prior Publication Data

US 2018/0080193 A1 Mar. 22, 2018

(51) Int. Cl.

| | |
|---|---|
| ***E02F 3/43*** | (2006.01) |
| ***E02F 3/34*** | (2006.01) |
| ***E02F 9/20*** | (2006.01) |
| ***E02F 9/26*** | (2006.01) |

(52) U.S. Cl.

CPC ..... *E02F 3/434* (2013.01); *E02F 3/34* (2013.01); *E02F 9/2041* (2013.01); *E02F 9/2062* (2013.01); *E02F 9/26* (2013.01)

(58) Field of Classification Search

CPC . E02F 3/434; E02F 3/34; E02F 9/2041; E02F 9/2062; E02F 9/26

See application file for complete search history.

(56) References Cited

U.S. PATENT DOCUMENTS 5,065,326 A 11/1991 Sahm
5,446,980 A 9/1995 Rocke
5,493,798 A 2/1996 Rocke et al.
5,528,498 A * 6/1996 Scholl ..... E02F 3/437 37/348
6,247,538 B1 * 6/2001 Takeda ..... E02F 3/842 172/2
6,321,153 B1 11/2001 Rocke et al.
6,357,132 B1 * 3/2002 Banks ..... F15B 15/2838 33/700
7,555,855 B2 7/2009 Alshaer et al.
7,752,778 B2 7/2010 Schoenmaker et al.
7,752,779 B2 7/2010 Schoenmaker et al.
7,797,860 B2 9/2010 Schoenmaker et al.
7,894,962 B2 2/2011 Sahlin et al.
(Continued)

FOREIGN PATENT DOCUMENTS

JP WO2014103498 A1 7/2014
WO WO2015107069 A1 7/2015

*Primary Examiner* — Calvin Cheung

(74) *Attorney, Agent, or Firm* — Klintworth & Rozenblat IP LLP; Steven J. Wietrzny

(57) ABSTRACT

An automatic dump control system and method are disclosed for a loader having a boom and a bucket each positionable by hydraulic cylinders actuated by a hydraulic circuit. The control system includes a source of image data of a receptacle and a source of position data for the boom and the bucket. The control system includes a controller that: determines a height of the receptacle based on the image data; determines a difference between the height of the receptacle and a height of the bucket based on the position data; outputs one or more control signals to the hydraulic circuit to position at least one of the boom and the bucket at a target height above the receptacle; determines that the bucket is positioned over the receptacle; and outputs one or more control signals to the hydraulic circuit to dump a load in the bucket into the receptacle.

17 Claims, 8 Drawing Sheets

(56) References Cited

U.S. PATENT DOCUMENTS

| | | | | |
|---|---|---|---|---|
| 8,036,797 | B2 | 10/2011 | Johnson et al. | |
| 8,195,364 | B2 | 6/2012 | Norris et al. | |
| 8,200,398 | B2 | 6/2012 | Sahlin et al. | |
| 8,204,653 | B2 | 6/2012 | Sahlin et al. | |
| 8,386,133 | B2 | 2/2013 | Sahlin et al. | |
| 8,478,493 | B2 | 7/2013 | Anderson | |
| 8,498,796 | B2 | 7/2013 | Norris et al. | |
| 9,313,951 | B2 | 4/2016 | Herman et al. | |
| 2003/0019132 | A1* | 1/2003 | Kurenuma | E02F 3/437 37/348 |
| 2004/0124605 | A1 | 7/2004 | McClure et al. | |
| 2005/0027420 | A1* | 2/2005 | Fujishima | E02F 9/2045 701/50 |
| 2008/0234901 | A1* | 9/2008 | Johnson | E02F 9/2029 701/50 |
| 2013/0222573 | A1* | 8/2013 | Onuma | E02F 9/24 348/82 |
| 2014/0261152 | A1* | 9/2014 | Tanaka | E02F 9/2033 116/230 |
| 2014/0288771 | A1 | 9/2014 | Li | |
| 2014/0338235 | A1* | 11/2014 | Ryan | E02F 3/435 37/443 |
| 2014/0343800 | A1* | 11/2014 | Nelson | E02F 3/845 701/49 |
| 2015/0077557 | A1 | 3/2015 | Han et al. | |
| 2015/0168136 | A1* | 6/2015 | Kamat | B60R 11/04 348/136 |
| 2015/0308070 | A1* | 10/2015 | Deines | E02F 3/434 701/50 |

* cited by examiner

SYSTEM AND METHOD FOR AUTOMATIC DUMP CONTROL

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicles and to increasing the efficiency of dumping operation of the work vehicle.

BACKGROUND OF THE DISCLOSURE

In the construction industry, various work machines, such as loaders, may be utilized in lifting and moving various materials. In certain examples, a loader may include a bucket pivotally coupled by a boom to a frame. One or more hydraulic cylinders are coupled to the boom and/or the bucket to move the bucket between positions relative to the frame to load the bucket with material.

Typically, once the bucket is loaded with material, the loader may be moved towards a receptacle to dump the loaded material. In certain instances, the receptacle may have a height, which may be different than a height of the boom and/or bucket. In instances where the boom and/or bucket is below the height of the receptacle, the loader may be unable to empty the bucket, which reduces an efficiency of the dumping operation. Moreover, in certain instances, the operator may be unaware that the boom and/or bucket is below the height of the receptacle, which may lead to damage to the receptacle and/or the loader.

SUMMARY OF THE DISCLOSURE

The disclosure provides a system and method for improving the efficiency of the dumping operation of a work vehicle, such as from a bucket of a loader.

In one aspect the disclosure provides an automatic dump control system for a loader work vehicle. The loader work vehicle has a boom and a bucket each positionable by hydraulic cylinders actuated by a hydraulic circuit. The control system includes a source of image data of a receptacle and a source of position data for the boom and the bucket. The control system includes a controller that: determines a height of the receptacle based on the image data; determines a difference between the height of the receptacle and a height of the bucket based on the position data; outputs one or more control signals to the hydraulic circuit to position at least one of the boom and the bucket at a target height above the receptacle based on the difference; determines that the bucket is positioned over the receptacle based on the image data and the position data; and outputs one or more control signals to the hydraulic circuit to position the bucket at a dump position to dump a load in the bucket into the receptacle based on the determination.

In another aspect the disclosure provides a method for automatic dump control for a loader work vehicle. The loader work vehicle has a boom and a bucket each positionable by hydraulic cylinders actuated by a hydraulic circuit. The method includes: receiving image data of a receptacle; determining, by a controller, a height of the receptacle based on the image data; determining, by the controller, a difference between the height of the receptacle and a height of the bucket based on a position of the boom and the bucket; outputting, by the controller, one or more control signals to the hydraulic circuit to position at least one of the boom and the bucket at a target height above the receptacle based on the difference; and outputting, by the controller, one or more control signals to the hydraulic circuit to position the bucket at a dump position based on the position of the boom and the bucket and the image data.

In yet another aspect the disclosure provides an automatic dump control system for a loader work vehicle. The loader work vehicle has a boom and a bucket each positionable by hydraulic cylinders actuated by a hydraulic circuit. The control system includes a source of image data of a receptacle and a source of position data for the boom and the bucket. The control system also includes a source of a speed of the loader work vehicle. The control system includes a controller that: determines a height of the receptacle and a distance to the receptacle based on the image data; determines a difference between the height of the receptacle and a height of the bucket based on the position data; determines whether the bucket is positionable at a target height above the receptacle based on the difference, the position data, the speed of the loader work vehicle and the distance; and outputs one or more control signals to the hydraulic circuit to position at least one of the boom and the bucket at the target height above the receptacle based on the determination.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
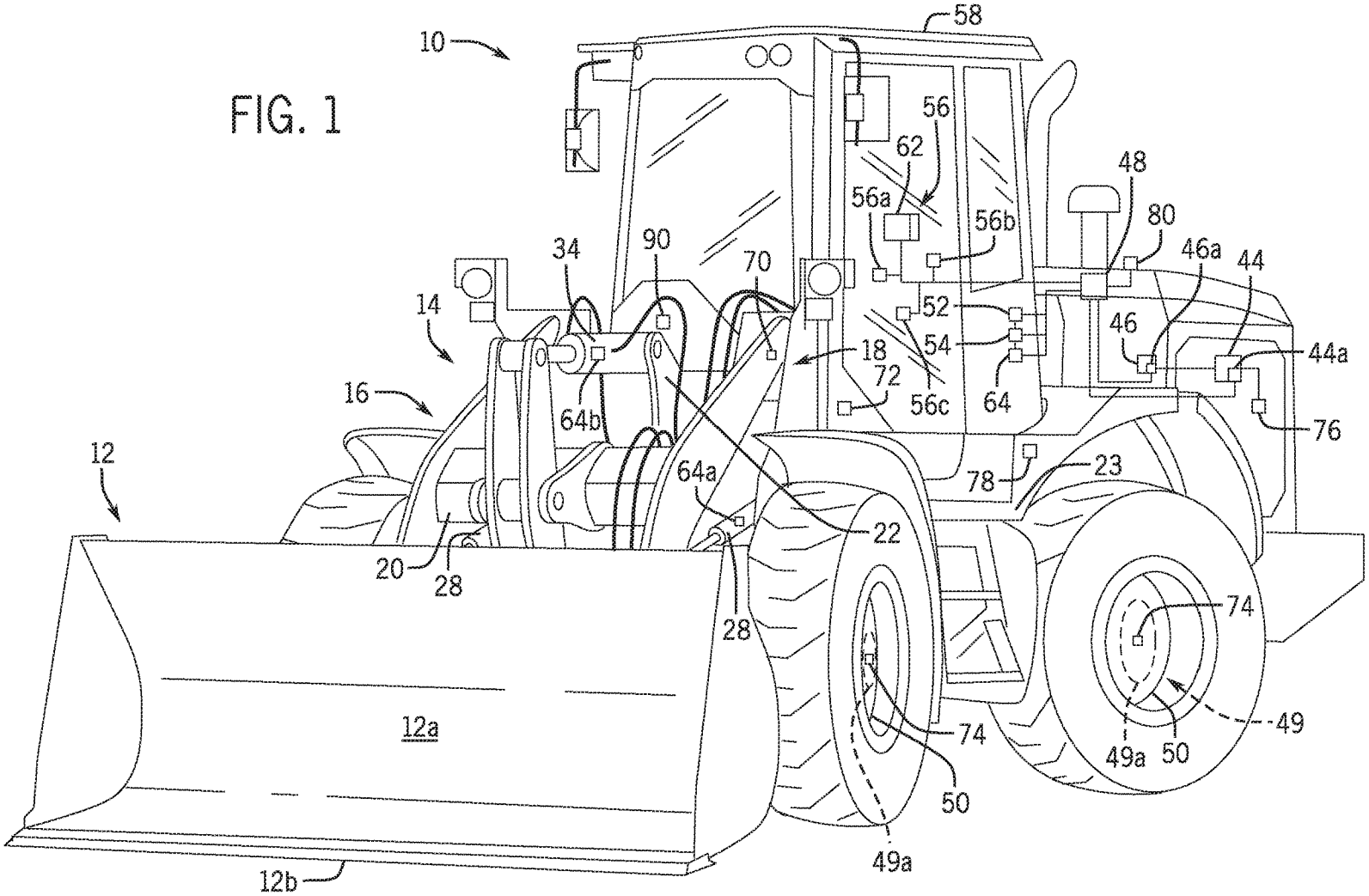
FIG. 1 is a perspective view of an example work vehicle in the form of a wheel loader in which the disclosed automatic dump control system and method may be used.

The following describes one or more example embodiments of the disclosed system and method, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the loader described herein is merely one example embodiment of the present disclosure.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

The following describes one or more example implementations of the disclosed system and method for improving the efficiency of a dumping operation by controlling movement of a bucket and/or boom assembly of a loader work vehicle, as shown in the accompanying figures of the drawings described briefly above. Generally, the disclosed control systems and methods (and work vehicles in which they are implemented) provide for improved efficiency in a dumping operation as compared to conventional systems by automatically adjusting a height of the bucket and/or a boom assembly coupled to the bucket to assist in dumping materials in the bucket into a receptacle. By moving the bucket and/or boom assembly, the bucket and/or boom assembly of the work vehicle more efficiently performs the dumping operation by ensuring that the bucket and/or boom assembly is properly positioned to empty the bucket into the receptacle. The substantially automatic movement of the bucket and/or boom assembly also ensures or prevents damage to the bucket, boom assembly and/or the receptacle caused by the bucket and/or boom assembly being improperly positioned prior to dumping the bucket.

The disclosed dump control system may be used to receive operator commands for requesting assistance in a dumping operation. As used herein, the phrase "dumping operation" is used to denote the movement of the bucket from a first, load position to a third, dump position in which materials in the bucket are able to fall from the bucket due to the force of gravity.

Upon receipt of the operator command, the controller determines a position of the bucket and the boom assembly. The controller also receives and processes image data from a receptacle sensor, and determines a height of the receptacle. In various embodiments, the receptacle can comprise an articulated dump truck, a dumpster, a dump truck, an open trailer, a mound of material at a dump site, etc. The receptacle sensor can comprise a camera, such as a stereo camera. The controller determines a difference in a height of the bucket and/or boom assembly and the height of an edge of the receptacle. Based on a determination of the difference, the controller generates and outputs a user or operator interface for display on the display that provides a textual and/or graphical indication of the difference between the boom assembly and bucket position relative to the edge of the receptacle. In addition, based on the determination of that the bucket and/or boom assembly are below the height of the edge of the receptacle, the controller outputs one or more control signals to a hydraulic circuit (e.g. hydraulic pumps and/or control valves) associated with the boom assembly and the bucket to raise the boom assembly and the bucket to a target height above the edge of the receptacle, which ensures the boom assembly and the bucket will not contact the receptacle during the dumping operation and also ensures that the materials will be dumped within the receptacle.

In certain embodiments, the controller also determines a time that it will take for the hydraulic circuit to move the boom assembly and the bucket to the target height. The controller also processes the image data to determine a distance to the receptacle. If, based on a current speed of the work vehicle and the distance to the receptacle, the hydraulic circuit cannot move the boom assembly and the bucket in time, the controller outputs one or more control signals to a propulsion system associated with the work vehicle, such as an engine control module, to reduce a speed of the work vehicle to provide additional time for the hydraulic circuit to move the boom assembly and the bucket. In addition, or alternatively, the controller outputs one or more control signals to a brake system associated with the work vehicle to apply a braking force to one or more wheels of the work vehicle to slow the speed of the work vehicle to provide the additional time. Stated another way, the controller determines a distance to the receptacle based on the image data, receives a source of a speed of the loader work vehicle, and outputs control signals to the hydraulic circuit and a propulsion system of the loader work vehicle based on the position of the boom assembly and the bucket, the distance, and the speed of the loader work vehicle to raise the height of the bucket above the height of the receptacle before the loader work vehicle traverses the distance. This improves the efficiency of the dumping operation, and prevents damage to the work vehicle and the receptacle.

In certain embodiments, the controller also determines whether the bucket is positioned over the receptacle based on image data from the receptacle sensor. Based on this determination, the controller outputs one or more control signals to the hydraulic circuit to move the bucket into the third, dump position to dump the materials in the bucket into the receptacle. Once the dumping operation is complete, the controller determines whether a rap-out command has been received via a user input device. If the rap-out command is received, the controller outputs one or more control signals to the hydraulic circuit to move the bucket back and forth to empty any remaining materials into the receptacle.

In certain embodiments, the controller also determines whether a command has been received to move the work vehicle into a reverse gear range after the completion of the dumping operation. If this command is received, the controller determines whether the boom assembly and the bucket are positioned at the target height such that the work vehicle can be moved away from the receptacle without the bucket contacting the receptacle. If the boom assembly and the bucket are at the target height, the controller enables the reverse gear range. Otherwise, the controller outputs one or more control signals to the hydraulic circuit to move the boom assembly and the bucket to the target height prior to enabling the reverse gear range. This further prevents damage to the work vehicle and/or the receptacle during the dumping operation.

As noted above, the disclosed dump control system may be utilized with regard to various machines or work vehicles with load buckets, including loaders and other machines for lifting and moving various materials, for example, various machines used in the agriculture, construction and forestry industries. Referring to FIG. 1, in some embodiments, the disclosed dump control system may be used with a wheel or track loader work vehicle 10 to control a dump operation of an end effector, which in this example is a scoop or bucket 12. By controlling the dump operation of the bucket 12, cycle time of the dumping operation may be improved, thereby increasing the efficiency of the operation of the loader work vehicle 10. Moreover, the disclosed dump control system and method may prevent damage to the work vehicle and/or a receptacle 8 (FIG. 2) during the dump operation. It will be understood that the configuration of the loader work vehicle 10 is presented as an example only. In this regard, the disclosed dump control system may be implemented with a front loader attachment fixed or removably coupled to an otherwise non-loader work vehicle, such as a tractor. Moreover, while the receptacle 8 is generally illustrated herein as comprising a load bin associated with a work vehicle, such as an articulated dump truck, it will be understood that the present disclosure is not so limited. In this regard, the receptacle 8 can comprise any suitable container for receiving a load from the bucket 12 of the loader work vehicle 10, such as a dumpster, open trailer, and can also comprise a pile of material. Thus, generally, the receptacle 8 comprises any suitable location for dumping materials from the bucket 12.

In the embodiment depicted, the bucket 12 is pivotally mounted to a boom assembly 14. In this example, the boom assembly 14 includes a first boom 16 and a second boom 18, which are interconnected via a crossbeam 20 to operate in parallel. Each of the first boom 16 and the second boom 18 are coupled to a frame portion 22 of a frame 23 of the loader work vehicle 10 at a first end, and are coupled at a second end to the bucket 12 via a respective one of a first pivot linkage 24 and a second pivot linkage (not shown).

Figure 2:
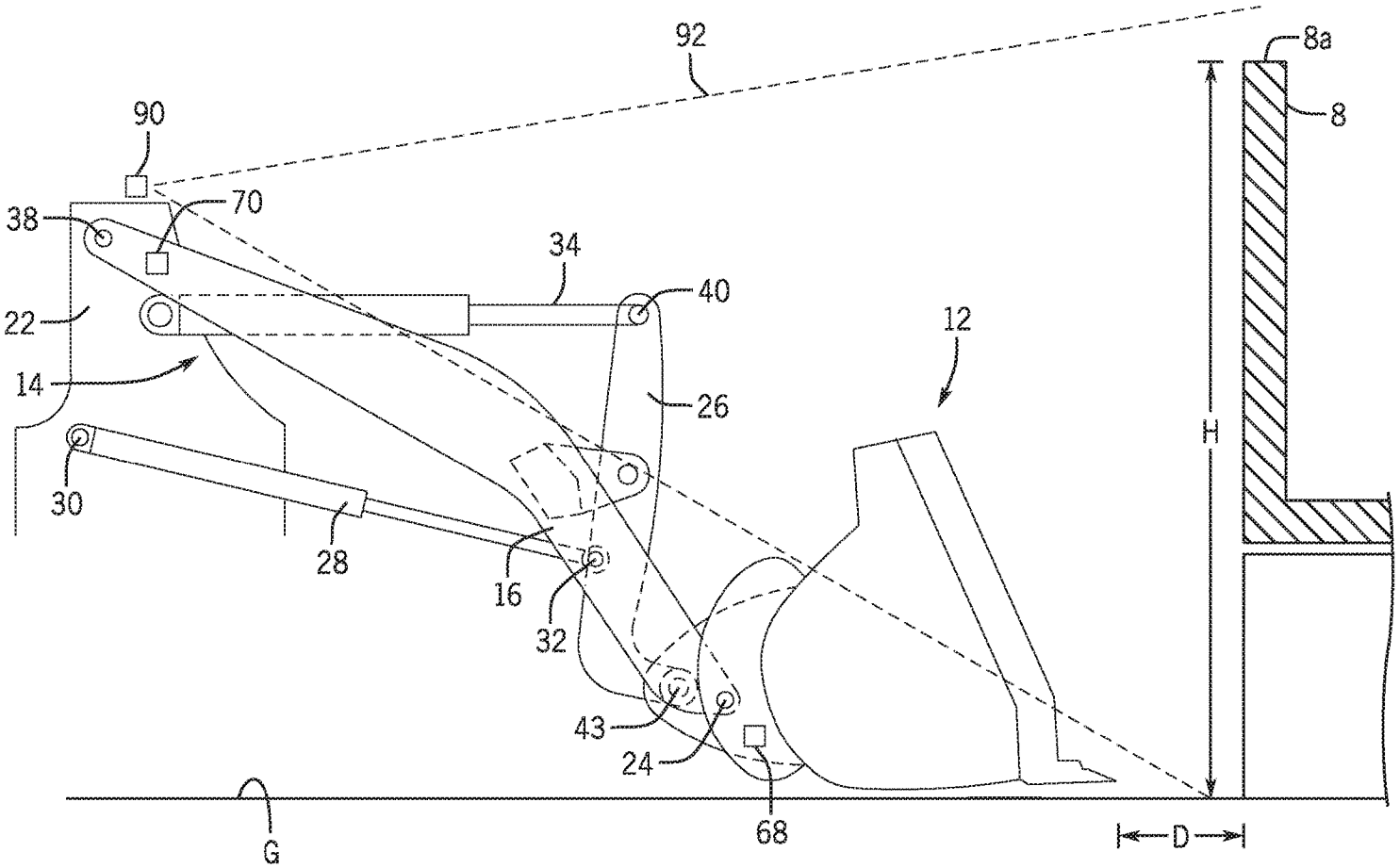
FIG. 2 is a side view of a boom assembly and bucket of the work vehicle of FIG. 1 adjacent to a receptacle, with the bucket in a first, load position.

One or more hydraulic cylinders 28 are mounted to the frame portion 22 and to the boom assembly 14, such that the hydraulic cylinders 28 may be driven or actuated in order to move or raise the boom assembly 14 relative to the loader work vehicle 10. Generally, the boom assembly 14 includes two hydraulic cylinders 28, one coupled between the frame portion 22 and the first boom 16; and one coupled between the frame portion 22 and the second boom 18. It should be noted, however, that the loader work vehicle 10 may have any number of hydraulic cylinders, such as one, three, etc. Each of the hydraulic cylinders 28 includes an end mounted to the frame portion 22 at a pin 30 and an end mounted to the respective one of the first boom 16 and the second boom 18 at a pin 32 (FIG. 2). Upon activation of the hydraulic cylinders 28, the boom assembly 14 may be moved between various positions to elevate the boom assembly 14, and thus, the bucket 12 relative to the frame 23 of the loader work vehicle 10.

With reference to FIG. 2, one or more hydraulic cylinders 34 are mounted to the frame portion 22 and a pivot linkage 26. Generally, the loader work vehicle 10 includes a single hydraulic cylinder 34 associated with the pivot linkage 26. In this example, the hydraulic cylinder 34 includes an end mounted to the frame portion 22 at a pin 38 and an end mounted to the pivot linkage 26 at a pin 40. Upon activation of the hydraulic cylinder 34, the bucket 12 may be moved between various positions to pivot the bucket 12 relative to the boom assembly 14.

Thus, in the embodiment depicted, the bucket 12 is pivotable about the boom assembly 14 by the hydraulic cylinder 34. In other configurations, other movements of a bucket or end effector may be possible. Further, in some embodiments, a different number or configuration of hydraulic cylinders or other actuators may be used. Generally, the dump control system disclosed herein may be applied with respect to any type of actuator capable of producing relative movement of a boom and/or bucket.

Thus, it will be understood that the configuration of the bucket 12 is presented as an example only. In this regard, a hoist boom (e.g. the boom assembly 14) may be generally viewed as a boom that is pivotally attached to a vehicle frame, and that is also pivotally attached to an end effector. Similarly, a pivoting linkage (e.g., the pivot linkage 26) may be generally viewed as a pin or similar feature effecting pivotal attachment of a receptacle (e.g. bucket 12) to a vehicle frame. In this light, a tilt actuator (e.g., the hydraulic cylinders 34) may be generally viewed as an actuator for pivoting a receptacle with respect to a hoist boom, and the hoist actuator (e.g. the hydraulic cylinders 28) may be generally viewed as an actuator for pivoting a hoist boom with respect to a vehicle frame.

Figure 2A:
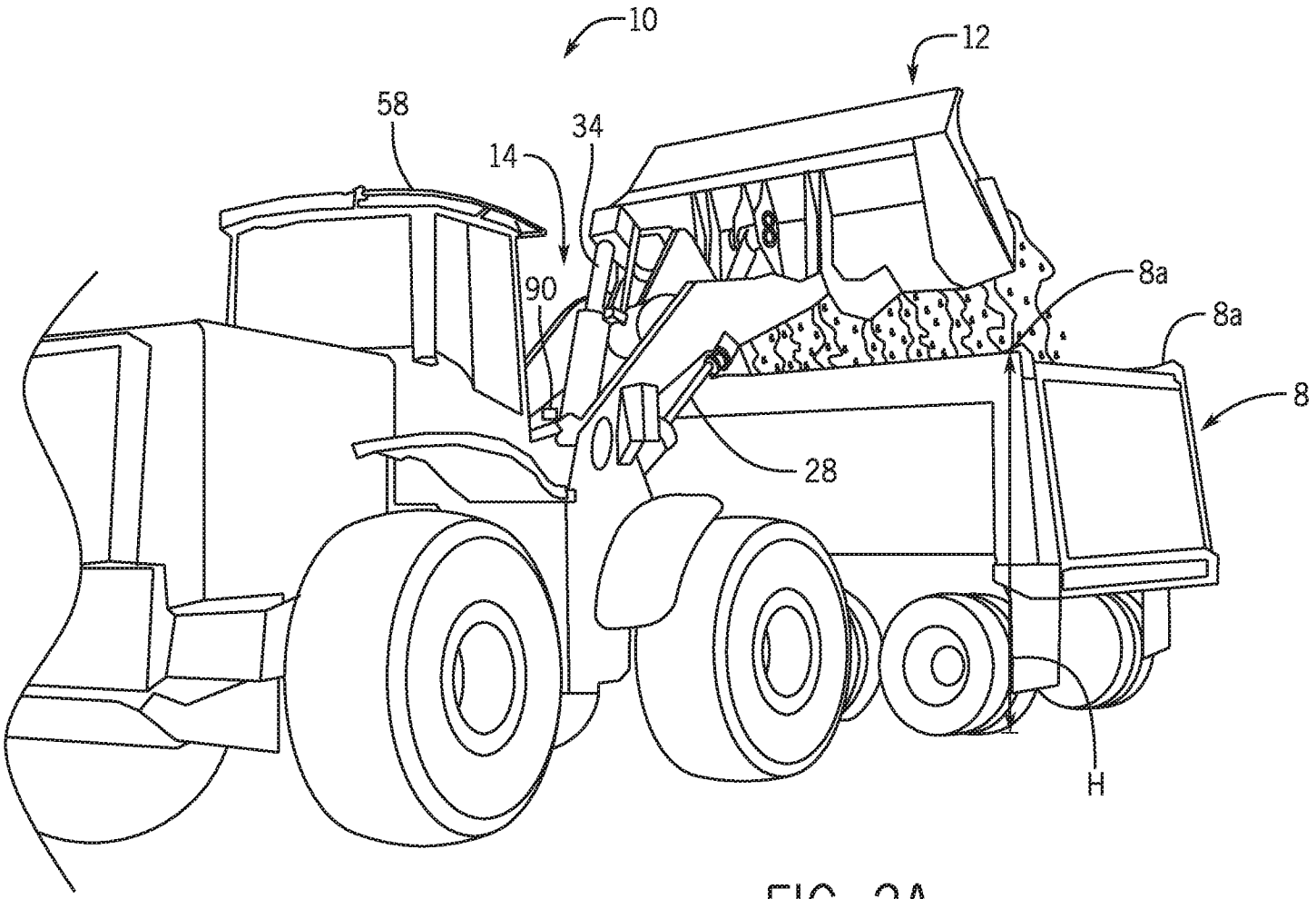
FIG. 2A is a side view of the loader work vehicle, with the boom assembly and the bucket positioned at a target height above a receptacle and the bucket in the third, dump position to dump materials in the bucket into the receptacle.

With additional reference to FIG. 2, the bucket 12 is coupled to the pivot linkage 26 via a coupling pin 43. The coupling pin 43 cooperates with the pivot linkage 26 to enable the movement of the bucket 12 upon activation of the hydraulic cylinder 34. As will be discussed further herein, the bucket 12 is movable upon activation of the hydraulic cylinder 34 between a first, load position (FIG. 2), a second, loaded position and a third, dump position (FIG. 2A) along with various positions in between. In the first, load position, the bucket 12 is capable of receiving various materials. In the second, loaded position, the bucket 12 is pivoted upward or relative to the horizontal by the actuation of the hydraulic cylinder 34 such that the bucket 12 is loaded with and retains the various materials. In the third, dump position, with reference to FIG. 2A, the bucket 12 is pivoted downward relative to the horizontal by the actuation of the hydraulic cylinder 34 such that the bucket 12 empties the materials into the receptacle 8. With reference to FIG. 2, the bucket 12 generally defines a container 12*a* for the receipt of various materials, such as dirt, rocks, wet dirt, sand, hay, etc. In one example, the container 12*a* may receive about 2.0 cubic yards of material to over about 5.0 cubic yards of material.

The bucket 12 may include an elongated sidewall 12*b* on a bottommost edge to direct material into the container 12*a*.

With reference to FIG. 1, the loader work vehicle 10 includes a propulsion system that supplies power to move the loader work vehicle 10. The propulsion system includes an engine 44 and a transmission 46. The engine 44 supplies power to a transmission 46. In one example, the engine 44 is an internal combustion engine, such as the diesel engine, that is controlled by an engine control module 44*a*. As will be discussed further herein, the engine control module 44*a* receives one or more control signals or control commands from a controller 48 to adjust a power output of the engine 44. It should be noted that the use of an internal combustion engine is merely an example, as the propulsion device can be a fuel cell, an electric motor, a hybrid-gas electric motor, etc., which is responsive to one or more control signals from the controller 48 to reduce a power output by the propulsion device.

The transmission 46 transfers the power from the engine 44 to a suitable driveline coupled to one or more driven wheels 50 (and tires) of the loader work vehicle 10 to enable the loader work vehicle 10 to move. As is generally known, the transmission 46 can include a suitable gear transmission, which can be operated in a variety of ranges containing one or more gears, including, but not limited to a park range, a neutral range, a reverse range, a drive range, a low range, etc. A current range of the transmission 46 may be provided by a transmission control module 46*a* in communication with the controller 48, or may be provided by a sensor that observes a range shifter or range selection unit associated with the transmission 46. As will be discussed, the controller 48 may output one or more control signals or control commands to the transmission 46 or transmission control module 46*a* to enable an operator selected range for the operation of the transmission 46. The controller 48 may also output one or more control signals or control commands for the transmission control module 46*a* that set a predetermined vehicle speed that the loader work vehicle 10 is not to exceed. For example, the controller 48 queries a look-up table or calibration table that is stored in a memory associated with and accessible by the controller 48, and retrieves a predetermined reduced vehicle speed based on a difference between a current position of the loader work vehicle 10 and a distance to the receptacle 8 and/or a difference between a current position of the bucket 12 of the loader work vehicle 10 and the height of the receptacle 8.

The loader work vehicle 10 also includes a braking system 49. As is generally known, the braking system 49 includes one or more brakes 49*a*, which are associated with a respective one of the driven wheels 50. The brakes 49*a* can comprise a drum brake, a disc brake, or any suitable assembly for slowing or stopping the rotation of the respective driven wheel 50 based on the receipt of one or more control signals from the controller 48. As will be discussed, the controller 48 may output the one or more control signals or control commands to the braking system 49 to actuate one or more of the brakes 49*a* to slow the rotation of the driven wheels 50.

The loader work vehicle 10 also includes one or more pumps 52, which may be driven by the engine 44 of the loader work vehicle 10. Flow from the pumps 52 may be routed through various control valves 54 and various conduits (e.g., flexible hoses and lines) in order to drive the hydraulic cylinders 28, 34. Flow from the pumps 52 may also power various other components of the loader work vehicle 10. The flow from the pumps 52 may be controlled in various ways (e.g., through control of the various control valves 54), in order to cause movement of the hydraulic cylinders 28, 34, and thus, the bucket 12 relative to the loader work vehicle 10. In this way, for example, a movement of the boom assembly 14 and/or bucket 12 between various positions relative to the frame 23 of the loader work vehicle 10 may be implemented by various control signals to the pumps 52, control valves 54, and so on.

Generally, the controller 48 (or multiple controllers) may be provided, for control of various aspects of the operation of the loader work vehicle 10, in general. The controller 48 (or others) may be configured as a computing device with associated processor devices and memory architectures, as a hard-wired computing circuit (or circuits), as a programmable circuit, as a hydraulic, electrical or electro-hydraulic controller, or otherwise. As such, the controller 48 may be configured to execute various computational and control functionality with respect to the loader work vehicle 10 (or other machinery). In some embodiments, the controller 48 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 48 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 48 may be in electronic, hydraulic, mechanical, or other communication with various other systems or devices of the loader work vehicle 10 (or other machinery). For example, the controller 48 may be in electronic or hydraulic communication with various actuators, sensors, and other devices within (or outside of) the loader work vehicle 10, including various devices associated with the pumps 52, control valves 54, and so on. The controller 48 may communicate with other systems or devices (including other controllers) in various known ways, including via a CAN bus (not shown) of the loader work vehicle 10, via wireless or hydraulic communication means, or otherwise. An example location for the controller 48 is depicted in FIG. 1. It will be understood, however, that other locations are possible including other locations on the loader work vehicle 10, or various remote locations.

In some embodiments, the controller 48 may be configured to receive input commands and to interact with an operator via a human-machine interface 56, which may be disposed inside a cab 58 of the loader work vehicle 10 for easy access by the operator. The human-machine interface 56 may be configured in a variety of ways. In some embodiments, the human-machine interface 56 may include one or more joysticks 56*a*, various switches or levers, one or more buttons 56*b*, a touchscreen interface that may be overlaid on a display 62, a keyboard, an audible device 56*c*, a microphone associated with a speech recognition system, or various other human-machine interface devices. In one example, the one or more joysticks 56*a* may receive an input, such as a request to change a gear range of the transmission 46. The one or more buttons 56*b* may receive an input, such as a request for an automatic dump control operation. In one example, the audible device 56*c* comprises a speaker that is responsive to one or more control signals from the controller 48 to emit a sound that may be heard by the operator.

Various sensors may also be provided to observe various conditions associated with the loader work vehicle 10. In some embodiments, various sensors 64 (e.g., pressure, flow or other sensors) may be disposed near the pumps 52 and control valves 54, or elsewhere on the loader work vehicle 10. For example, sensors 64 may include one or more pressure sensors that observe a pressure within the hydraulic circuit, such as a pressure associated with at least one of the one or more hydraulic cylinders 28, 34. The sensors 64 may also observe a pressure associated with the hydraulic pumps 52. As a further example, one or more sensors 64*a* may be coupled to a respective one of the hydraulic cylinders 28 to observe a pressure within the hydraulic cylinders 28 and generate sensor signals based thereon. Further, one or more sensors 64*b* may be coupled to a respective one of the hydraulic cylinder 34 to observe a pressure within the hydraulic cylinder 34 and generate sensor signals based thereon.

In some embodiments, with reference to FIG. 2, various sensors may be disposed near the bucket 12. For example, sensors 66 (e.g. inertial measurement sensors) may be coupled near the bucket 12 in order to observe or measure parameters including the acceleration of the boom assembly 14 near the bucket 12 and so on. Thus, the sensors 66 observe an acceleration of the boom assembly 14 near the bucket 12 and generate sensor signals thereon, which may indicate if the boom assembly 14 and/or bucket 12 is decelerating or accelerating.

In some embodiments, various sensors 68 (e.g., rotary angular position sensor 68) may be configured to detect the angular orientation of the bucket 12 relative to the boom assembly 14, or detect various other indicators of the current orientation or position of the bucket 12. Thus, the sensors 68 generally include bucket position sensors that indicate a position of the bucket 12 relative to the boom assembly 14. Other sensors may also (or alternatively) be used. For example, a linear position or displacement sensors may be utilized in place of the rotary angular position sensors 68 to determine the length of the hydraulic cylinder 34 relative to the boom assembly 14. In such a case, the detected linear position or displacement may provide alternative (or additional) indicators of the current position of the bucket 12.

Various sensors 70 (e.g., angular position sensor 70) may be configured to detect the angular orientation of the boom assembly 14 relative to the frame portion 22, or detect various other indicators of the current orientation or position of the boom assembly 14 relative to the frame 23 of the loader work vehicle 10. Thus, the sensors 70 generally include boom position sensors that indicate a position of the boom assembly 14 relative to the frame 23 of the loader work vehicle 10. Other sensors may also (or alternatively) be used. For example, a linear position or displacement sensors may be utilized in place of the angular position sensors 70 to determine the length of the hydraulic cylinders 28 relative to the frame portion 22. In such a case, the detected linear position or displacement may provide alternative (or additional) indicators of the current position of the boom assembly 14.

With reference to FIG. 1, various sensors 72-78 may also be disposed on or near the frame 23 of the loader work vehicle 10 in order to measure various parameters associated with the loader work vehicle 10. In one example, sensor 72 observes a speed of the loader work vehicle 10 and generates sensor signals based thereon. Sensor 74 observes a speed of one or more of the driven wheels 50 of the loader work vehicle 10 and generates sensor signals based thereon. Sensor 76 observes a speed of the engine 44 of the loader work vehicle 10 (e.g. a tachometer) and generates sensor signals based thereon. Sensor 78 observes an acceleration of the frame 23 of the loader work vehicle 10, and generates sensor signals based thereon.

In certain embodiments, one or more location-sensing devices may also be included on or associated with the loader work vehicle 10. For example, a GPS device 80 may use GPS technology to detect the location of the loader work vehicle 10 at regular intervals (e.g., during a loading operation). The detected locations may then be communicated via a suitable wired or wireless interface, such as a CAN bus, to the controller 48 associated with the loader work vehicle 10. In certain embodiments, the detected locations may additionally (or alternatively) be communicated to one or more remote systems.

In one example, the loader work vehicle 10 also includes a receptacle sensor 90. With reference to FIG. 2, the receptacle sensor 90 observes a height H of the receptacle 8 and a distance D to the receptacle 8, and generates sensor signals based thereon. Generally, the receptacle sensor 90 observes the height H of the receptacle 8 from a ground surface G; however, the receptacle sensor 90 may observe the height H of the receptacle 8 relative to another location, such as a location of a portion of the loader work vehicle 10. In this example, the receptacle sensor 90 is coupled to the frame portion 22 of the loader work vehicle 10; however, it will be understood that the receptacle sensor 90 can be coupled to any desired location of the loader work vehicle 10, such as the cab 58, a hood associated with the engine 44, the boom assembly 14 of the loader work vehicle 10, etc.

In this example, the receptacle sensor 90 comprises a camera assembly, which observes an area that may include the receptacle 8 and generates image data based thereon. It should be noted that while the following description refers to a "camera assembly" any suitable visual sensor any be employed to obtain an imaged area that may include the receptacle 8. Moreover, the receptacle sensor 90 can comprise a lidar, radar or similar sensor that observes an object, such as the receptacle 8, and a distance to an object, such as the receptacle 8, and generates sensor signals based thereon. In certain embodiments, a receptacle sensor 90 may be mounted to or associated with the loader work vehicle 10 (or otherwise positioned) in order to capture images at least of a field of view 92, which in this example, is forward of the loader work vehicle 10. The receptacle sensor 90 may be in electronic (or other) communication with the controller 48 (or other devices) and may include various numbers of cameras of various types. In certain embodiments, the receptacle sensor 90 may include a color camera capable of capturing color images. In other embodiments, the receptacle sensor 90 may include an infrared camera to capture infrared images. In certain embodiments, the receptacle sensor 90 may include a grayscale camera to capture grayscale images. In certain embodiments, the receptacle sensor 90 may include a stereo camera assembly capable of capturing stereo images. For example, the receptacle sensor 90 may include a stereo camera with two or more lenses and image sensors, or multiple cameras arranged to capture stereoscopic images of the field of view 92, including features of the receptacle 8 within the field of view 92.

Images may be captured by the receptacle sensor 90 according to various timings or other considerations. In certain embodiments, for example, the receptacle sensor 90 may capture images continuously as the loader work vehicle 10 executes a dump (or other) operation. In certain embodiments, embedded control system (not shown) for the receptacle sensor 90 may cause the receptacle sensor 90 to capture images of the field of view 92 at regular time intervals as loader work vehicle 10 executes a dump (or other) operation.

The receptacle sensor 90 provides a source of local image data for the controller 48 associated with the loader work vehicle 10. It will be understood that various other sources of image data for the controller 48 may be available. For example, a portable electronic device (not shown) may provide a source of image data for the controller 48 (i.e. as a source of remote image data). The portable electronic device may be in communication with the loader work vehicle 10 to transmit data to a vehicle communication device (not shown) associated with the loader work vehicle 10 and to receive the data from the vehicle communication device. The portable electronic device is any suitable electronic device external to the loader work vehicle 10, including, but not limited to, a hand-held portable electronic device, such as a tablet computing device, mobile or smart phone, personal digital assistant, a laptop computing device, etc.

The various components noted above (or others) may be utilized to control movement of the bucket 12 via control of the movement of the one or more hydraulic cylinders 28, 34. Accordingly, these components may be viewed as forming part of the dump control system for the loader work vehicle 10. Each of the sensors 64-78, the GPS device 80 and the receptacle sensor 90 are in communication with the controller 48 via a suitable communication architecture, such as a CAN bus.

In various embodiments, the controller 48 outputs one or more control signals or control commands to the hydraulic cylinders 28, 34 associated with the loader work vehicle 10 based on one or more of the sensor signals received from the sensors 64-78, image data received from the receptacle sensor 90, location data received from the GPS device 80 and input received from the human-machine interface 56, and further based on the dump control system and method of the present disclosure. The controller 48 outputs the one or more control signals or control commands to the pumps 52 and/or control valves 54 associated with hydraulic cylinder 34 to move the boom assembly 14 and/or bucket 12 to a target height based on one or more of the sensor signals received from the sensors 64-78, image data received from the receptacle sensor 90, location data received from the GPS device 80 and input received from the human-machine interface 56. By controlling the movement of the boom assembly 14 and/or bucket 12 to the target height based in part on the sensor signals and the image data received from the receptacle sensor 90, the efficiency of the dump operation is increased. In some embodiments, the controller 48 also outputs the one or more control signals or control commands to the engine control module 44*a* to decrease a speed of the engine 44 based on one or more of the sensor signals received from the sensors 64-78, image data received from the receptacle sensor 90, and input received from the human-machine interface 56. The decrease in engine speed enables the boom assembly 14 and/or bucket 12 to move to a target height above the receptacle 8 prior to the loader work vehicle 10 reaching the receptacle 8, which reduces the risk of damage to the boom assembly 14, bucket 12 and/or receptacle 8. The controller 48 outputs the one or more control signals or control commands to the transmission control module 46*a* to enable a reverse gear range of the transmission 46 based on one or more of the sensor signals received from the sensors 64-78, image data received from the receptacle sensor 90 and input received from the human-machine interface 56. This further prevents damage to the boom assembly 14, bucket 12 and/or receptacle 8 as the loader work vehicle 10 moves away from the receptacle 8 after the dumping operation.

Figure 3:
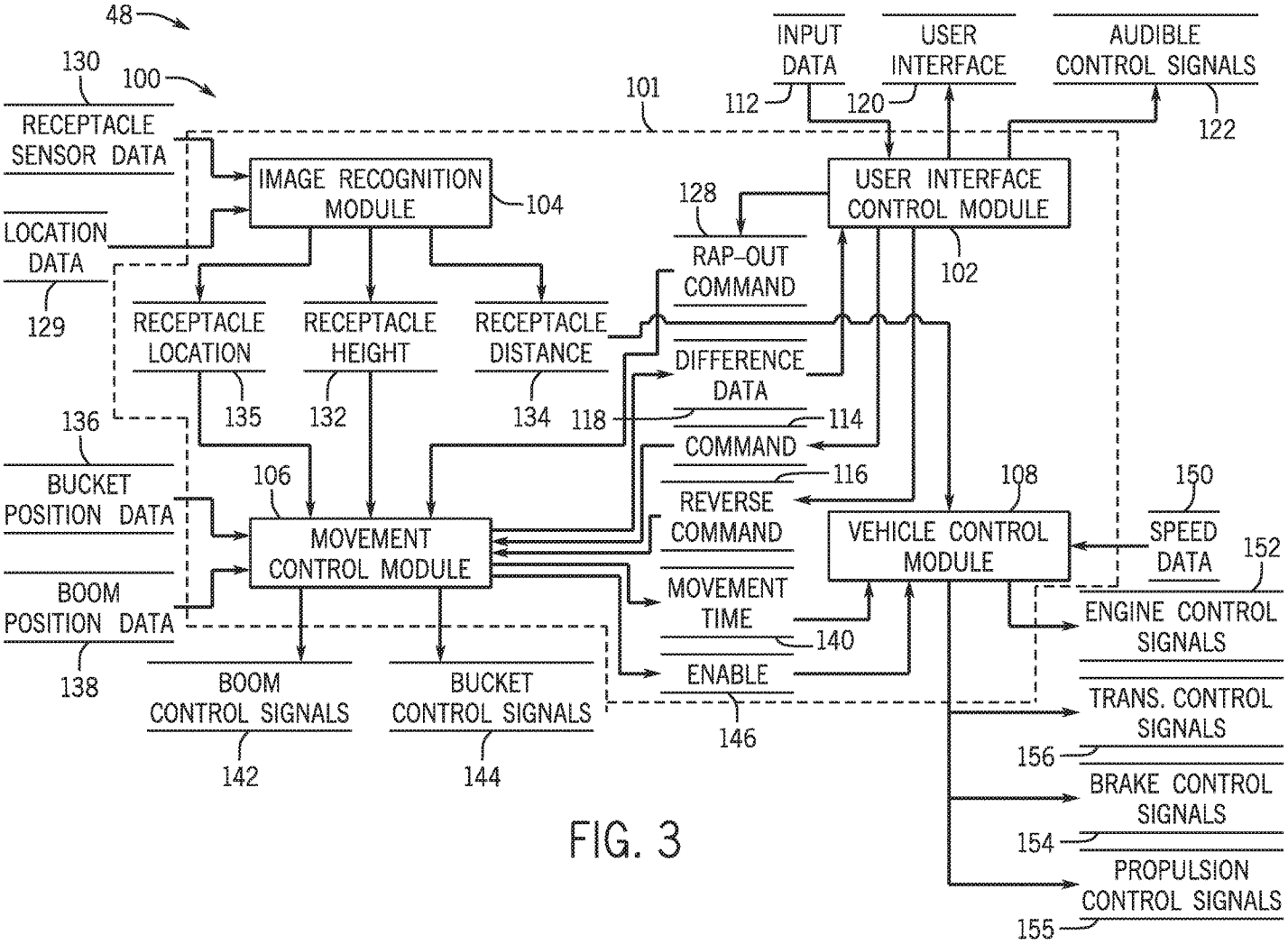
FIG. 3 is a dataflow diagram illustrating an example dump control system in accordance with various embodiments.

Referring now also to FIG. 3, a dataflow diagram illustrates various embodiments of a dump control system 100 for the loader work vehicle 10, which may be embedded within a control module 101 associated with the controller 48. Various embodiments of the dump control system 100 according to the present disclosure can include any number of sub-modules embedded within the control module 102. As can be appreciated, the sub-modules shown in FIG. 3 can be combined and/or further partitioned to similarly control the hydraulic cylinders 28 for moving the boom assembly 14, to control the hydraulic cylinder 34 for moving the bucket 12, control the speed of the engine 44 of the loader work vehicle 10 via the engine control module 44*a*, to enable a reverse gear range of the transmission 46 and to output a display and/or audible data to the human-machine interface 56. Inputs to the dump control system 100 are received from the sensors 64-78 (FIG. 1), received from the receptacle sensor 90, received from the GPS device 80, received from the human-machine interface 56 (FIG. 1), received from other control modules (not shown) associated with the loader work vehicle 10, and/or determined/modeled by other sub-modules (not shown) within the controller 48. In various embodiments, the control module 101 includes a user interface (UI) control module 102, an image recognition module 104, a movement control module 106 and a vehicle control module 108.

The UI control module 102 receives input data 112 from the human-machine interface 56. The input data 112 includes a command for an automatic dump procedure for the bucket 12, and also includes a command for a reverse gear range of the transmission 46. In certain embodiments, the input data 112 includes a command to perform a rap-out procedure, in which the bucket 12 is moved back and forth while dumping to remove materials that may be stuck to the bucket 12. In one example, the command for the automatic dump procedure is received via one of the buttons 56*b*, and the command for the reverse gear range is received from the one of the joysticks 56*a*. The command for the rap-out procedure may also be received from one of the joysticks 56*a*. It will be understood, however, that the input data 112 may also be received from a touch screen interface, a speech recognition system, etc. The UI control module 102 interprets the input data 112 and sets a command 114 for the movement control module 106, and sets a reverse command 116 for the movement control module 106 and the vehicle control module 108. The UI control module 102 also interprets the input data 112 and sets a rap-out command 128 for the movement control module 106. The command 114 is the operator command for the automatic dump procedure, and the reverse command 116 is the command for the reverse gear range of the transmission 46. The rap-out command 128 is a command to move the bucket 12 back and forth or to perform a rap-out procedure, as requested by the operator.

The UI control module 102 receives as input difference data 118 from the movement control module 106. As will be discussed further herein, the difference data 118 is a difference between a current position of the bucket 12 and the boom assembly 14, and a target height that the bucket 12 needs to reach to successfully dump the materials in the bucket 12 into the receptacle 8 as computed by the movement control module 106. Based on the difference data 118, the UI control module 102 generates or outputs a user interface 120 for the display 62 and optionally, outputs one or more audible control signals 122 to the audible device

56*c*. The user interface 120 is a graphical user interface for display on the display 62, which graphically and/or textually indicates the difference between the current position of the bucket 12 and the boom assembly 14 relative to the target height. The one or more audible control signals 122 command the audible device 56*c* to emit a sound, such as a beep, tone, chime or other audible cue that informs the operator of the difference between the current position of the bucket 12 and the boom assembly 14 and the target height for the bucket 12 to dump the materials into the receptacle 8.

Figure 4:
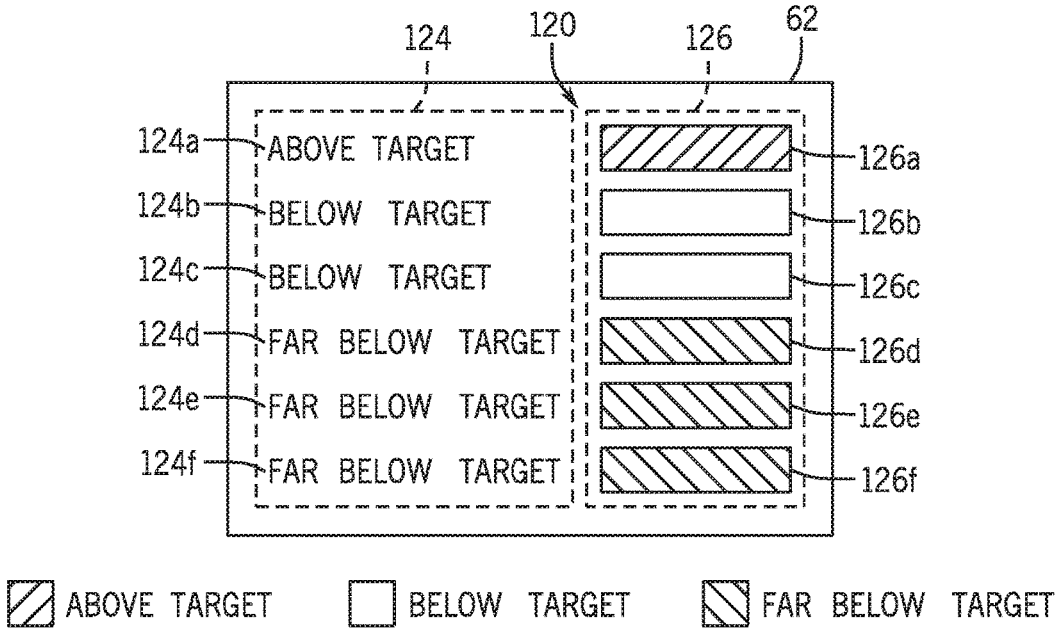
FIG. 4 is an exemplary user interface generated by the dump control system in accordance with various embodiments.

With reference to FIG. 4, an exemplary user interface 120 generated by the UI control module 102 for display on the display 62 is shown. In this example, the user interface 120 generally comprises a first column 124 and a second column 126, and thus, generally presents the difference data 118 as a bar chart. The first column 124 provides labels 124*a*-124*f*, which are associated with respective bars 126*a*-126*f* in the second column 126. Exemplary labels 124*a*-124*f* include: "Above Target" 124*a*, "Below Target" 124*b*, "Below Target" 124*c*, "Far Below Target" 124*d*, "Far Below Target" 124*e* and "Far Below Target" 124*f*. Thus, the difference between the current position of the bucket 12 and the target height increases from 124*a*-124*f*. Each of the bars 126*a*-126*f* are positioned adjacent to the respective labels 124*a*-124*f* and provide a visual or graphical indicator of the difference. For example, each of the bars 126*a*-126*f* provide a color indicator as to the difference between the current position of the bucket 12 and the target height necessary to dump the bucket 12. For example, bar 126*a* is in a green color, bars 126*b* and 126*c* are in a yellow color and bars 126*d*-126*f* are in a red color.

In this example, the difference data 118 comprises a numerical value, which the UI control module 102 interprets to generate the user interface 120. For example, the UI control module 102 interprets the difference data 118 and determines the label 124*a*-124*f* and associated bar 126*a*-126*f* based on the numerical value. In certain embodiments, the UI control module 102 can query a look-up table, for example, to determine the label 124*a*-124*f* and associated bar 126*a*-126*f* based on the numerical value of the difference data 118. As an example, the difference data 118 numerical value above zero can be determined as "Above Target," and the bar 126*a* can be displayed in green. A numerical value of the difference data 118 as between zero and about negative five can be determined as "Below Target," and the bar 126*b* can be displayed in yellow. A numerical value of the difference data 118 as between negative five and negative 10 can be determined as "Below Target," and the bar 126*c* can be displayed in yellow. A numerical value of the difference data 118 as between negative 10 and negative 15 can be determined as "Far Below Target," and the bar 126*d* can be displayed in red. A numerical value of the difference data 118 as between negative 15 and negative 20 can be determined as "Far Below Target," and the bar 126*e* can be displayed in red. A numerical value of the difference data 118 as below negative 20 can be determined as "Far Below Target," and the bar 126*f* can be displayed in red. It should be noted that the above numerical values are merely exemplary, and moreover, the numerical values can comprise absolute values.

Thus, the user interface 120 allows the operator to easily discern the current position of the bucket 12 as compared to the required position of the bucket 12. It should be understood, however, that the present teachings are not limited to the user interface 120 illustrated in FIG. 4. Rather, the user interface 120 generated by the UI control module 102 can comprise any suitable user interface that graphically and/or textually informs the operator of the difference between the current position of the bucket 12 and the boom assembly 14, and the target height for the bucket 12 to successfully dump the materials into the receptacle 8. Moreover, the user interface 120 need not comprise both text and graphics, rather, the user interface 120 can provide a text notification (e.g. "Above Target") or a graphical display (e.g. green bar).

With reference back to FIG. 3, the image recognition module 104 receives as input receptacle sensor data 130. The receptacle sensor data 130 comprises the sensor signals or sensor data from the receptacle sensor 90. In the example of the receptacle sensor 90 as a camera assembly, the receptacle sensor data 130 is image data received from the camera assembly. The image recognition module 104 processes the image data from the receptacle sensor 90 and determines a receptacle height 132, a receptacle distance 134 and a receptacle position 135. The receptacle height 132 is a height of an edge 8*a* of the receptacle 8 (FIG. 2), and the receptacle distance 134 is the distance D to the receptacle 8 (FIG. 2). The receptacle position 135 is a true or false indication as to whether the bucket 12 is positioned over the receptacle 8 based on the image data from the receptacle sensor 90. In one example, the image recognition module 104 processes the image data from the receptacle sensor 90 to determine an initial region of interest (such as an area surrounding the receptacle 8) in the image data, and based on the determination of the initial region of interest, the image recognition module 104 determines whether a target, such as the edge 8*a* of the receptacle 8, is within the region of interest. Based on the determination that the edge 8*a* of the receptacle 8 is within the region of interest captured by the receptacle sensor 90, the image recognition module 104 analyzes the image to determine the position and orientation of the edge 8*a* of the receptacle 8 in a world reference frame. The position of the edge 8*a* of the receptacle is determined in 3D world coordinates. Based on the determination of the position of the edge 8*a*, the image recognition module 104 sets the Y-coordinate value of the 3D world coordinates as the receptacle height 132.

The image recognition module 104 also receives as input location data 129. The location data comprises the location of the loader work vehicle 10, as detected by the GPS device 80. Generally, the location of the loader work vehicle 10 is provided to the image recognition module 104 in 3D world coordinates. Based on the location data 129, and the determined position of the edge 8*a*, the image recognition module 104 computes a distance between the loader work vehicle 10 and the receptacle 8, and sets this data as the receptacle distance 134. Based on the location of the loader work vehicle 10 and the determined position of the edge 8*a* of the receptacle 8, the image recognition module 104 can set the receptacle position 135 to true if the location of the loader work vehicle 10 is within a predefined threshold of the determined position of the edge 8*a* of the receptacle 8. Otherwise, the image recognition module 104 sets the receptacle position 135 to false. Further details regarding the detection of a target in image data can be found in commonly assigned U.S. Pub. No. 2015/0077557, titled "Vehicle Auto-Motion Control System" to Shufeng Han et al., which is incorporated herein by reference.

Alternatively, the image recognition module 104 can extract a position of the edge 8*a* of the receptacle 8 based on the teachings of commonly assigned U.S. Pat. No. 9,313,951, titled "Optical Image Capture for Controlling a Position of a Harvester Transfer Device" to Herman Herman et. al., which is incorporated herein by reference. The receptacle 8 can also include a location-sensing device, if desired. In this example, the image recognition module 104 processes the image data from the receptacle sensor 90 to identify features in the captured image, such as the edge 8*a* of the receptacle 8. With the receptacle sensor 90 as a stereo camera, the image recognition module 104 estimates the receptacle distance 134 and the receptacle height 132 from the signals received from the receptacle sensor 90. The receptacle position 135 is also determined from the signals received from the receptacle sensor 90 in the example of the receptacle sensor 90 as a stereo camera.

The image recognition module 104 sets the determined receptacle height 132 for the movement control module 106 and sets the determined receptacle distance 134 for the vehicle control module 108. The image recognition module 104 also sets the receptacle position 135 for the movement control module 106.

The movement control module 106 receives as input the receptacle height 132, the receptacle distance 134, the command 114, the reverse command 116 and the rap-out command 128. The movement control module 106 also receives as input the receptacle position 135, the bucket position data 136 and the boom position data 138. The bucket position data 136 comprises the sensor signals or sensor data from the sensor 68, which indicates a position of the bucket 12 relative to the boom assembly 14. The boom position data 138 comprises the sensor signals or sensor data from the sensor 70, which indicates the angular orientation of the boom assembly 14 relative to the frame portion 22. As will be discussed, the movement control module 106 determines a movement time 140 for a movement of the bucket 12 and the boom assembly 14 to the target height based on the command 114, the bucket position data 136, the boom position data 138 and the receptacle height 132. The movement control module 106 also outputs the difference data 118 based on the command 114, the bucket position data 136, the boom position data 138 and the receptacle height 132. The movement control module 106 also outputs boom control signals 142 and bucket control signals 144 based on the bucket position data 136, the boom position data 138 and the receptacle height 132. The movement control module 106 also outputs an enable 146 based on the reverse command 116, the bucket position data 136, the boom position data 138 and the receptacle height 132. The movement control module 106 outputs the bucket control signals 144 based on the rap-out command 128. The movement control module 106 also outputs the bucket control signals 144 based on the receptacle position 135.

Figure 5:
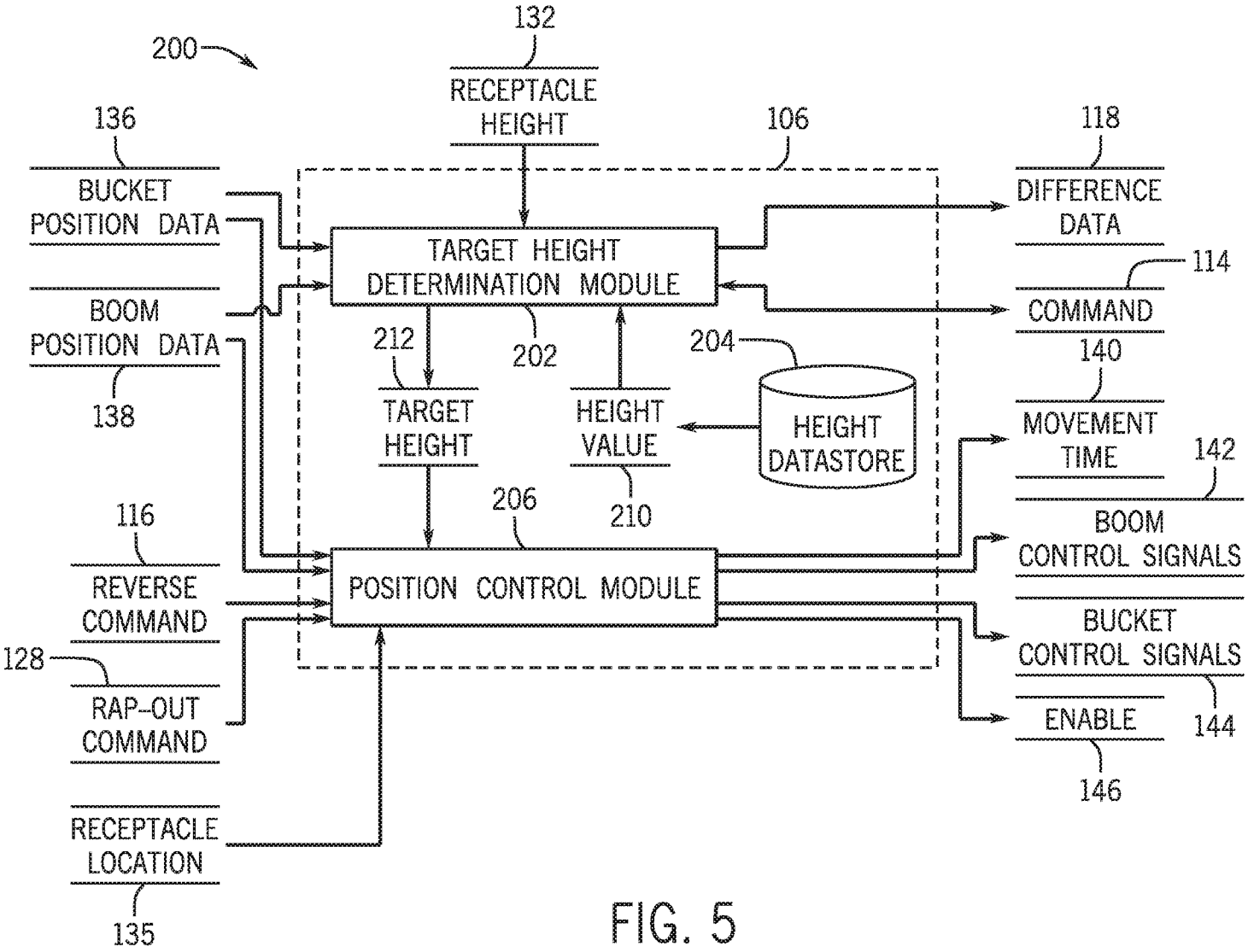
FIG. 5 is a dataflow diagram illustrating an example movement control system in accordance with various embodiments.

Referring now also to FIG. 5, a dataflow diagram illustrates various embodiments of a movement control system 200 for the loader work vehicle 10, which may be embedded within the movement control module 106 associated with the controller 48. Various embodiments of the movement control system 200 according to the present disclosure can include any number of sub-modules embedded within the movement control module 106. As can be appreciated, the sub-modules shown in FIG. 5 can be combined and/or further partitioned to similarly control the hydraulic cylinders 28 for moving the boom assembly 14, to control the hydraulic cylinder 34 for moving the bucket 12, and to enable a reverse gear range of the transmission 46. Inputs to the movement control system 200 are received from the sensors 64-78 (FIG. 1), received from the human-machine interface 56 (FIG. 1), received from other control modules (not shown) associated with the loader work vehicle 10, and/or determined/modeled by other sub-modules (not shown) within the controller 48. In various embodiments, the movement control module 106 includes a target height determination module 202, a height datastore 204 and a position control module 206.

The height datastore 204 stores one or more values for a height of the boom assembly 14 and bucket 12 to dump the material from the bucket 12 into the receptacle 8 without contacting the edge 8*a* of the receptacle 8. In other words, the height datastore 204 stores one or more height values 210 associated with the boom assembly 14 and the bucket 12 based on the determined height of the edge 8*a* of the receptacle 8. The height values 210 are based on calibration or experimental data, which are predefined or factory set (e.g. default values). It should be noted, however, that the height datastore 204 may also include one or more tables (e.g., lookup tables or interpolation tables) for the determination of a target height for the boom assembly 14 and the bucket 12 to dump the bucket 12 without contacting the edge 8*a* of the receptacle 8.

The target height determination module 202 receives as input the command 114. Based on the receipt of the command 114, the target height determination module 202 receives and processes the receptacle height 132, the bucket position data 136 and the boom position data 138. The target height determination module 202 determines a current position of the bucket 12 relative to the boom assembly 14 based on the bucket position data 136 and determines a current position of the boom assembly 14 relative to the frame portion 22 based on the boom position data 138. As a height of the frame portion 22 from a ground G (FIG. 2) is known or comprises a default, factory defined value, that can be stored in a memory associated with the target height determination module 202, the target height determination module 202 determines, based on the determined relative positions of the boom assembly 14 and the bucket 12, a current height of the boom assembly 14 and a current height of the bucket 12 from the ground G. The target height determination module 202 determines whether a difference exists between the current height of the boom assembly 14 and the current height of the bucket 12, and the receptacle height 132. Stated another way, the target height determination module 202 determines whether the current height of the boom assembly 14 and the current height of the bucket 12 is greater than or less than the receptacle height 132. Based on this determination, the target height determination module 202 sets the difference data 118 for the UI control module 102. In certain embodiments, the difference data 118 is the numerical value of the difference in heights.

Based on the receptacle height 132, the target height determination module 202 queries the height datastore 204 and retrieves the height value 210 that corresponds to the height of the edge 8*a* of the receptacle 8 from the receptacle height 132. The target height determination module 202 sets the retrieved height value 210 as a target height 212 for the position control module 206.

The position control module 206 receives as input the target height 212. The position control module 206 also receives and processes the bucket position data 136 and the boom position data 138. Based on the target height 212, the bucket position data 136 and the boom position data 138, the position control module 206 outputs the boom control signals 142 and the bucket control signals 144. The boom control signals 142 are one or more control signals for the pumps 52 and/or control valves 54 to actuate the hydraulic cylinders 28 to move the boom assembly 14. The bucket control signals 144 are one or more control signals for the pumps 52 and/or control valves 54 to actuate the hydraulic cylinder 34 to move the bucket 12. Generally, the position control module 206 outputs the boom control signals 142 and the bucket control signals 144 to command the pumps 52 and/or control valves 54 to actuate the hydraulic cylinders 28, 34 at a predefined maximum hydraulic flow rate to close the distance between the bucket position data 136 and the boom position data 138, and the target height 212. Once the boom assembly 14 and the bucket 12 are within a threshold of the target height 212, the position control module 206 outputs the boom control signals 142 and the bucket control signals 144 to adjust the hydraulic flow rate supplied by the pumps 52 and/or control valves 54 to a predetermined hydraulic flow rate that is less than the maximum flow rate to slow the final movement of the boom assembly 14 and the bucket 12 to the target height 212. In certain examples, the position control module 206 outputs the boom control signals 142 and the bucket control signals 144 based on a proportional-integral-derivative (PID) control loop, and thus, in certain embodiments, the position control module 206 may comprise a PID controller.

Based on the difference between the bucket position data 136 and the boom position data 138, and the target height 212, the position control module 206 also determines the movement time 140. The movement time 140 comprises an amount of time required to move the boom assembly 14 and the bucket 12 based on the difference between the bucket position data 136 and the boom position data 138, and the target height 212. In various embodiments, the movement time 140 can be determined based on a known or default value associated with the hydraulic circuit of the loader work vehicle 10, which can be stored in a memory associated with the position control module 206. Stated another way, the hydraulic circuit of the loader work vehicle 10 may have a known rating for the movement of the boom assembly 14 and the bucket 12 within a period of time. Based on this known rating and the difference, the position control module 206 determines the amount of time required to move the boom assembly 14 and the bucket 12 to the target height 212, and sets this as the movement time 140 for the vehicle control module 108.

The position control module 206 also receives as input the reverse command 116. Based on the reverse command 116, the position control module 206 determines whether the bucket 12 and the boom assembly 14 are at the target height 212 based on the bucket position data 136 and the boom position data 138. If the bucket 12 and the boom assembly 14 are above the target height 212, the position control module 206 sets the enable 146 for the vehicle control module 108. The enable 146 indicates that the loader work vehicle 10 can be moved away from the receptacle 8 without the boom assembly 14 or the bucket 12 contacting the edge 8*a* of the receptacle 8. Otherwise, the position control module 206 outputs the boom control signals 142 and the bucket control signals 144 to move the boom assembly 14 and the bucket 12 back to the target height 212. Once the boom assembly 14 and the bucket 12 are at the target height 212, the position control module 206 sets the enable 146 for the vehicle control module 108.

The position control module 206 also receives as input the rap-out command 128. Based on the rap-out command 128, the position control module 206 outputs the bucket control signals 144. The bucket control signals 144 actuate the hydraulic cylinder 34 to move the bucket 12 back and forth to perform the rap-out. The values for the pumps 52 and/or control valves 54 to actuate the hydraulic cylinder 34 to move the bucket 12 in the rap-out procedure may be default or factory set values for a hydraulic flow rate associated with a rap-out procedure. Alternatively, the values for the pumps 52 and/or control valves 54 to actuate the hydraulic cylinder 34 to move the bucket 12 can be retrieved from a look-up table based on an amount of input received by the operator to the one or more joysticks 56*a*.

The position control module 206 receives as input the receptacle position 135. Based on the receptacle position 135 as true, the position control module 206 outputs the bucket control signals 144. The bucket control signals 144 actuate the hydraulic cylinder 34 to move the bucket 12 to the dump position to empty the bucket 12 of the materials within the bucket 12. The values for the pumps 52 and/or control valves 54 to actuate the hydraulic cylinder 34 to move the bucket 12 to the dump position can be default or factory set values for a hydraulic flow rate associated with a movement to the dump position, or can be retrieved from a look-up or calibration table stored in a memory associated with the position control module 206. Based on the receptacle position 135 as false, the position control module 206 does not output the bucket control signals 144 and waits for the bucket 12 to be positioned over the receptacle 8 as indicated by the receptacle position 135 as true.

With reference back to FIG. 3, the vehicle control module 108 receives as input the receptacle distance 134 and the movement time 140. The vehicle control module 108 receives as input speed data 150, and processes the speed data 150 to determine a current speed of the loader work vehicle 10. The speed data 150 is the sensor data or sensor signals from the sensor 72. Based on the receptacle distance 134 and the current speed of the loader work vehicle 10, the vehicle control module 108 determines a time it will take for the loader work vehicle 10 to reach the receptacle 8. The vehicle control module 108 determines whether the time it will take for the loader work vehicle 10 to reach the receptacle 8 is equal to or greater than the movement time 140. If true, the vehicle control module 108 maintains the current speed of the loader work vehicle 10.

If, however, the time it will take for the loader work vehicle 10 to reach the receptacle 8 is determined to be less than the movement time 140, the vehicle control module 108 outputs engine control signals 152, brake control signals 154 and/or propulsion control signals 155. The engine control signals 152 include one or more control signals or control commands for the engine control module 44*a* to decrease the speed of the engine 44 (i.e. decrease the revolutions per minute (rpm)) to slow the speed of the loader work vehicle 10. The brake control signals 154 include one or more control signals for the braking system 49 to apply braking pressure to one or more of the driven wheels 50 to slow the speed of the loader work vehicle 10. The propulsion control signals 155 include one or more control signals for the transmission control module 46*a* to not exceed a predetermined reduced vehicle speed. The predetermined reduced vehicle speed is a vehicle speed that is less than a predetermined maximum rated vehicle speed for the loader work vehicle 10. In one example, the vehicle control module 108 queries a look-up table or a calibration table, that is stored in a memory or datastore associated with and accessible by the vehicle control module 108, and retrieves the predetermined reduced vehicle speed based on the receptacle distance 134. Alternatively, the vehicle control module 108 queries a look-up table or a calibration table, that is stored in a memory or datastore associated with and accessible by the vehicle control module 108, and retrieves the predetermined reduced vehicle speed based on the movement time 140. In other embodiments, the vehicle control module 108 calculates the predetermined vehicle speed based on the receptacle distance 134 and/or movement time 140.

The vehicle control module 108 also receives as input the reverse command 116. Based on the reverse command 116, the vehicle control module 108 determines whether the enable 146 has been received from the movement control module 106. Based on the receipt of the enable 146, the vehicle control module 108 outputs transmission control signals 156. The transmission control signals 156 include one or more control signals or control commands for the transmission control module 46*a* to shift the transmission 46 into the reverse gear range. In addition, based on the receipt of the enable 146, the vehicle control module 108 may output the propulsion control signals 155 to enable the loader work vehicle 10 to not exceed a predetermined maximum vehicle speed in the reverse gear range. In one example, the predetermined maximum vehicle speed is a factory-set or default value that the vehicle control module 108 retrieves from a memory or datastore associated with and accessible by the vehicle control module 108 based on the receipt of the enable 146. In other embodiments, the vehicle control module 108 queries a look-up table or a calibration table that is stored in a memory or datastore associated with and accessible by the vehicle control module 108, and retrieves the predetermined maximum vehicle speed based on receipt of the enable 146.

Figure 6:
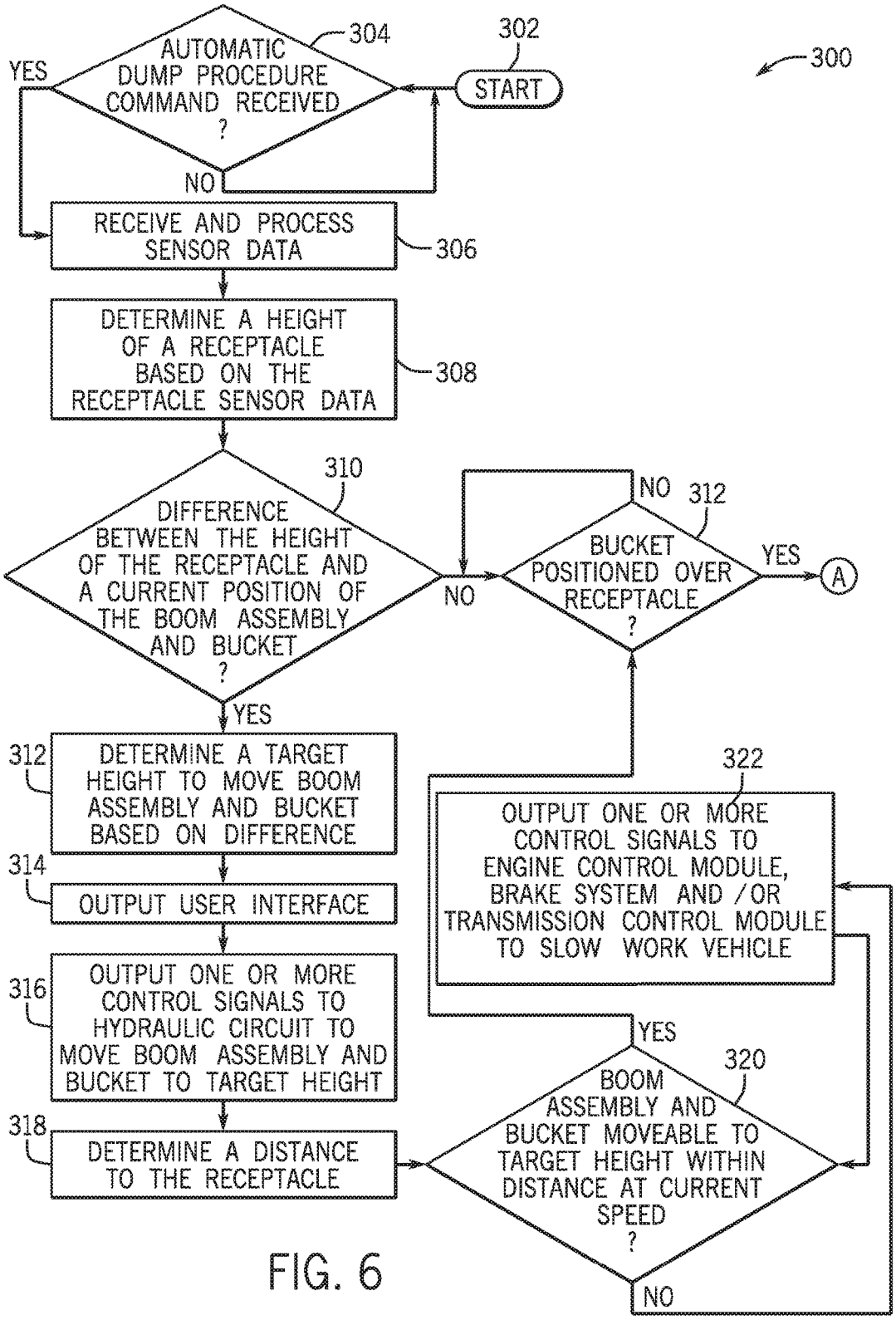
FIG. 6 is a flowchart illustrating an example control method of the disclosed dump control system of FIG. 1 in accordance with various embodiments.
Figure 7:
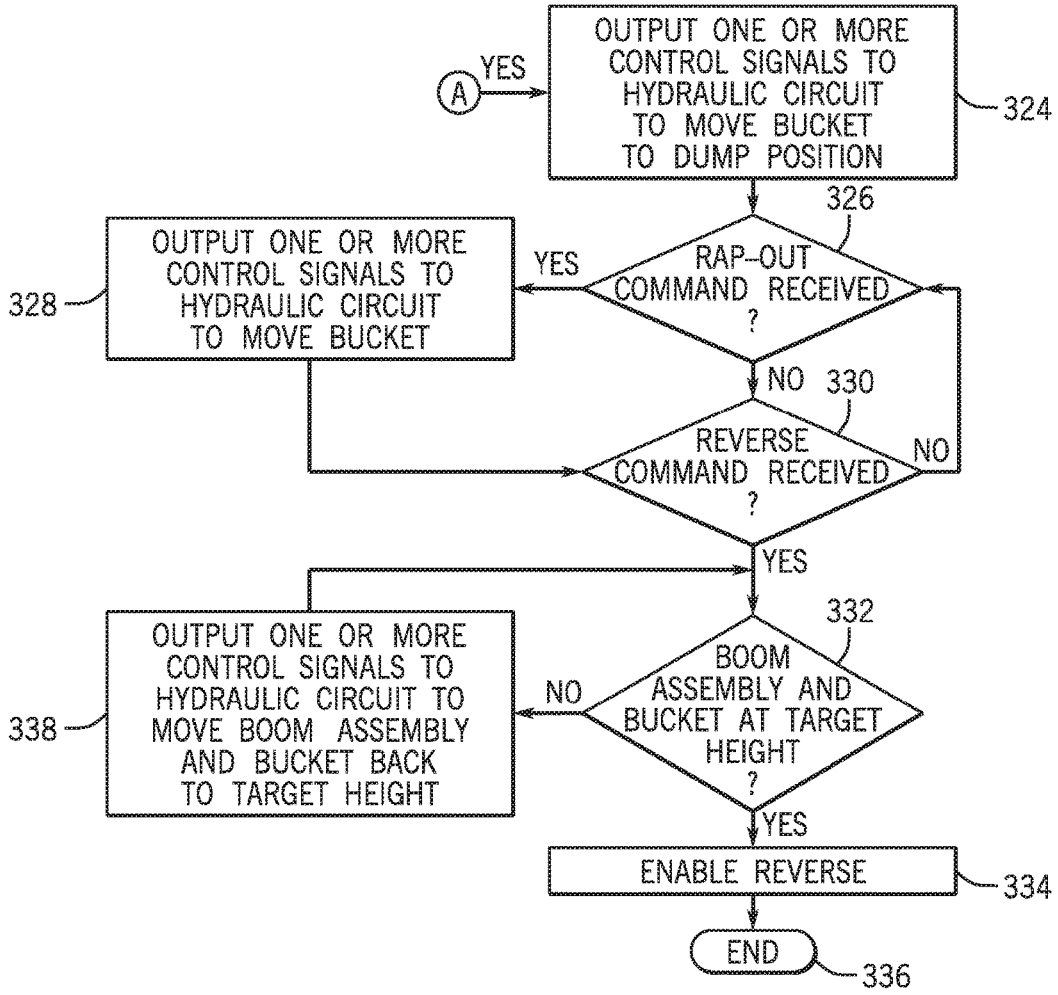
FIG. 7 is a continuation of the flowchart of FIG. 6.

Referring now also to FIGS. 6 and 7, a flowchart illustrates a control method 300 that may be performed by the controller 48 of FIGS. 1-5 in accordance with the present disclosure. As can be appreciated in light of the disclosure, the order of operation within the method is not limited to the sequential execution as illustrated in FIGS. 6 and 7, but may be performed in one or more varying orders as applicable and in accordance with the present disclosure.

In various embodiments, the method may be scheduled to run based on predetermined events, and/or can run based on the receipt of input data 112.

In one example, with reference to FIG. 6, the method begins at 302. At 304, the method determines whether an automatic dump procedure command has been received from the human-machine interface 56. If the automatic dump procedure command has been received, the method proceeds to 306. Otherwise, the method loops.

At 306, the method receives and processes the data from the sensors 64-78 and the receptacle sensor 90. At 308, the method determines the height of the edge 8*a* of the receptacle 8 based on the receptacle sensor data 130 or the image data from the receptacle sensor 90. At 310, the method determines whether there is a difference between the height of the receptacle 8 (i.e. the receptacle height 132) and the current position of the boom assembly 14 and the bucket 12 based on the bucket position data 136 and the boom position data 138. If there is no difference or the bucket 12 is positioned sufficiently above the height of the receptacle 8, the method proceeds to 312. Otherwise, at 314, the method determines the target height 212 for the boom assembly 14 and the bucket 12. In one example, the method queries the height datastore 204 to retrieve a height value 210 based on the bucket position data 136, the boom position data 138 and the receptacle height 132; and sets the height value 210 as the target height 212. At 314, the method outputs the user interface 120 to graphically and/or textually display to the operator the difference between the current position of the boom assembly 14 and the bucket 12 to the receptacle height 132.

At 316, the method outputs one or more control signals to the hydraulic circuit to actuate the hydraulic cylinders 28, 34 to move the boom assembly 14 and the bucket 12 to the target height 212 based on the difference between the bucket position data 136 and the boom position data 138, and the target height 212.

At 318, the method determines, based on the image data from the receptacle sensor 90, the distance to the receptacle 8 (i.e. determines the receptacle distance 134). Based on the receptacle distance 134, the method determines, at 320, whether the boom assembly 14 and the bucket 12 are movable to the target height within the distance to the receptacle 8 at the current speed of the loader work vehicle 10. In one example, the method determines the movement time 140 based on the difference between the bucket position data 136 and the boom position data 138, and the target height 212. Based on the speed of the loader work vehicle 10 from the sensor 72 and determined distance to the receptacle 8, the method computes the time required to move the boom assembly 14 and the bucket 12 to the target height 212. If the method determines that the time required to move the boom assembly 14 and the bucket 12 to the target height 212 at the current speed is greater than the movement time 140, the method proceeds to 322. Otherwise, the method proceeds to 312.

At 322, the method outputs one or more control signals to the engine control module 44*a* (i.e. outputs the engine control signals 152) to slow the speed of the engine 44, outputs the brake control signals 154 to the braking system 49 to slow the speed of the loader work vehicle 10 and/or outputs one or more propulsion control signals 155 to the transmission control module 46*a* such that a speed of the loader work vehicle 10 is not to exceed the predetermined reduced vehicle speed. In the example of the method outputting the one or more propulsion control signals 155, the method queries the memory or datastore associated with and accessible by the method to retrieve the predetermined reduced vehicle speed from the look-up table or calibration table, which is stored in the memory or the datastore, based on the receptacle distance 134. The method loops to 320.

At 312, the method determines, based on the receptacle position 135, whether the bucket 12 is positioned over the receptacle 8. If true, the method proceeds to A on FIG. 7. With reference to FIG. 7, from A, at 324 the method outputs one or more control signals to the hydraulic circuit to actuate the hydraulic cylinder 34 to move the bucket 12 to the dump position (i.e. outputs bucket control signals 144). Otherwise, if false at 312 (FIG. 6), the method loops.

With reference to FIG. 7, at 326, the method determines whether the rap-out command 128 has been received via input data 112 to the human-machine interface 56. If true, the method proceeds to 328, and outputs one or more control signals to actuate the hydraulic cylinder 34 to move the bucket 12 back and forth (i.e. outputs bucket control signals 144 for the rap-out procedure). Otherwise, at 330, the method determines whether the reverse command 116 has been received as input data 112 via the human-machine interface 56. If true, the method proceeds to 332. Otherwise, the method loops.

At 332, the method determines whether the boom assembly 14 and the bucket 12 are at the target height 212. If true, at 334, the method enables the selection of the reverse gear range by outputting the enable 146 to the transmission control module 46*a*. Optionally, the method also outputs the propulsion control signals 155 to the transmission control module 46*a* such that the speed of the loader work vehicle 10 in the reverse gear range is not to exceed the maximum predetermined vehicle speed. In one example, the method retrieves the maximum predetermined vehicle speed from the memory associated with and accessible by the method, and the maximum predetermined vehicle speed is a factory set value. The method ends at 336.

Otherwise, if false, the method, at 338, outputs one or more control signals to the hydraulic circuit to actuate the hydraulic cylinders 28, 34 to move the boom assembly 14 and the bucket 12 back to the target height 212. The method loops to 332.

As will be appreciated by one skilled in the art, certain aspects of the disclosed subject matter can be embodied as a method, system (e.g., a work vehicle control system included in a work vehicle), or computer program product. Accordingly, certain embodiments can be implemented entirely as hardware, entirely as software (including firmware, resident software, micro-code, etc.) or as a combination of software and hardware (and other) aspects. Furthermore, certain embodiments can take the form of a computer program product on a computer-usable storage medium having computer-usable program code embodied in the medium.

Any suitable computer usable or computer readable medium can be utilized. The computer usable medium can be a computer readable signal medium or a computer readable storage medium. A computer-usable, or computer-readable, storage medium (including a storage device associated with a computing device or client electronic device) can be, for example, but is not limited to, an electronic, magnetic, optical, electromagnetic, infrared, or semiconductor system, apparatus, or device, or any suitable combination of the foregoing. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device. In the context of this document, a computer-usable, or computer-readable, storage medium can be any tangible medium that can contain, or store a program for use by or in connection with the instruction execution system, apparatus, or device.

A computer readable signal medium can include a propagated data signal with computer readable program code embodied therein, for example, in baseband or as part of a carrier wave. Such a propagated signal can take any of a variety of forms, including, but not limited to, electromagnetic, optical, or any suitable combination thereof. A computer readable signal medium can be non-transitory and can be any computer readable medium that is not a computer readable storage medium and that can communicate, propagate, or transport a program for use by or in connection with an instruction execution system, apparatus, or device.

Aspects of certain embodiments are described herein can be described with reference to flowchart illustrations and/or block diagrams of methods, apparatus (systems) and computer program products according to embodiments of the disclosure. It will be understood that each block of any such flowchart illustrations and/or block diagrams, and combinations of blocks in such flowchart illustrations and/or block diagrams, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions can also be stored in a computer-readable memory that can direct a computer or other programmable data processing apparatus to function in a particular manner, such that the instructions stored in the computer-readable memory produce an article of manufacture including instructions which implement the function/act specified in the flowchart and/or block diagram block or blocks.

The computer program instructions can also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Any flowchart and block diagrams in the figures, or similar discussion above, can illustrate the architecture, functionality, and operation of possible implementations of systems, methods and computer program products according to various embodiments of the present disclosure. In this regard, each block in the flowchart or block diagrams can represent a module, segment, or portion of code, which includes one or more executable instructions for implementing the specified logical function(s). It should also be noted that, in some alternative implementations, the functions noted in the block (or otherwise described herein) can occur out of the order noted in the figures. For example, two blocks shown in succession (or two operations described in succession) can, in fact, be executed substantially concurrently, or the blocks (or operations) can sometimes be executed in the reverse order, depending upon the functionality involved. It will also be noted that each block of any block diagram and/or flowchart illustration, and combinations of blocks in any block diagrams and/or flowchart illustrations, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. An automatic dump control system for a loader work vehicle, the loader work vehicle having a boom and a bucket each positionable by hydraulic cylinders actuated by a hydraulic circuit, the control system comprising:

a source of image data of a receptacle;

a source of position data for the boom and the bucket; and a controller that:

determines a height of the receptacle based on the image data;

determines a difference between the height of the receptacle and a height of the bucket based on the position data;

outputs one or more control signals to the hydraulic circuit to position at least one of the boom and the bucket at a target height above the receptacle based on the difference;

determines that the bucket is positioned over the receptacle based on the image data and the position data; and outputs one or more control signals to the hydraulic circuit to position the bucket at a dump position to dump a load in the bucket into the receptacle based on the determination;

wherein the controller determines a distance to the receptacle based on the image data, receives a source of a speed of the loader work vehicle, and determines whether the bucket is positionable by the hydraulic circuit at the target height above the receptacle based on the position data, the distance and the speed of the loader work vehicle.

2. The control system of claim 1, wherein the controller outputs one or more control signals to a propulsion system of the loader work vehicle to slow the speed of the loader work vehicle based on the determination that the bucket is unable to be positioned at the target height within the distance.

3. The control system of claim 1, wherein the controller outputs one or more control signals to a braking system of the loader work vehicle to slow the speed of the loader work vehicle based on the determination that the bucket is unable to be positioned at the target height within the distance.

4. The control system of claim 1, wherein the loader work vehicle includes a display, and the controller generates a user interface for display on the display based on the difference.

5. The control system of claim 1, wherein the controller outputs one or more control signals to an audible device based on the difference.

6. The control system of claim 1, wherein the controller outputs one or more control signals to the hydraulic circuit to perform a rap-out procedure after the bucket is positioned at the dump position.

7. The control system of claim 1, wherein the loader work vehicle has a transmission including at least a reverse gear that is selectable by an operator, and based on the height of the receptacle, the position data and the selection of the reverse gear, the controller outputs one or more control signals to the hydraulic circuit to position at least one of the boom or the bucket at a target height above the receptacle.

8. The control system of claim 1, wherein the controller determines a distance to the receptacle based on the image data, receives a source of a speed of the loader work vehicle, and outputs control signals to the hydraulic circuit and a propulsion system of the loader work vehicle based on the position data, the distance, and the speed of the loader work vehicle to raise the height of the bucket above the height of the receptacle before the loader work vehicle traverses the distance.

9. A method for automatic dump control for a loader work vehicle, the loader work vehicle having a boom and a bucket each positionable by hydraulic cylinders actuated by a hydraulic circuit, the method comprising:

receiving image data of a receptacle;

determining, by a controller, a height of the receptacle based on the image data;

determining, by the controller, a difference between the height of the receptacle and a height of the bucket based on a position of the boom and the bucket;

outputting, by the controller, one or more control signals to the hydraulic circuit to position at least one of the boom and the bucket at a target height above the receptacle based on the difference;

outputting, by the controller, one or more control signals to the hydraulic circuit to position the bucket at a dump position based on the position of the boom and the bucket and the image data; and determining, by the controller, that the bucket is positioned above the receptacle based on the position of the boom and the bucket and the image data.

10. The method of claim 9, wherein the loader work vehicle includes a display, and the method further comprises:

generating, by the controller, a user interface for display on the display based on the difference.

11. The method of claim 9, further comprising:

outputting, by the controller, one or more control signals to the hydraulic circuit to perform a rap-out procedure after the bucket is positioned at the dump position.

12. The method of claim 9, further comprising:

determining, by the controller, a distance to the receptacle based on the image data; and determining, by the controller, whether the bucket is positionable by the hydraulic circuit at the target height above the receptacle based on the position data, the distance and a speed of the loader work vehicle.

13. The method of claim 12, further comprising:

outputting, by the controller, one or more control signals to a propulsion system of the loader work vehicle to slow the speed of the loader work vehicle based on the determination that the bucket is unable to be positioned at the target height within the distance.

14. The method of claim 12, further comprising:

outputting, by the controller, one or more control signals to a braking system of the loader work vehicle to slow the speed of the loader work vehicle based on the determination that the bucket is unable to be positioned at the target height within the distance.

15. An automatic dump control system for a loader work vehicle, the loader work vehicle having a boom and a bucket each positionable by hydraulic cylinders actuated by a hydraulic circuit, the control system comprising:

a source of image data of a receptacle;

a source of position data for the boom and the bucket, and a speed of the loader work vehicle; and a controller that:

determines a height of the receptacle and a distance to the receptacle based on the image data;

determines a difference between the height of the receptacle and a height of the bucket based on the position data;

determines whether the bucket is positionable at a target height above the receptacle based on the difference, the position data, the speed of the loader work vehicle and the distance; and outputs one or more control signals to the hydraulic circuit to position at least one of the boom and the bucket at the target height above the receptacle based on the determination;

wherein the controller outputs control signals to the hydraulic circuit and a propulsion system of the loader work vehicle based on the position data, the distance, and the speed of the loader work vehicle to raise the height of the bucket above the height of the receptacle before the loader work vehicle traverses the distance.

16. The control system of claim 15, wherein the controller determines that the bucket is positioned over the receptacle based on the image data and the position data and outputs one or more control signals to the hydraulic circuit to position the bucket at a dump position to dump a load in the bucket into the receptacle based on the determination.

17. The control system of claim 15, wherein the controller outputs one or more control signals to a propulsion system of the loader work vehicle to slow the speed of the loader work vehicle based on the determination or the controller outputs one or more control signals to a braking system of the loader work vehicle to slow the speed of the loader work vehicle based on the determination.

* * * * *